US010264942B2

(12) United States Patent
Zhu

(10) Patent No.: US 10,264,942 B2
(45) Date of Patent: Apr. 23, 2019

(54) FLAT MOP

(71) Applicant: Jiaxing Jackson Travel Products Co., Ltd., Jiaxing, Zhejiang (CN)

(72) Inventor: Xue Lin Zhu, Zhejiang (CN)

(73) Assignee: Jiaxing Jackson Travel Products Co., Ltd., Jiaxing, Zhejiang (CN)

( * ) Notice: Subject to any disclaimer, the term of this patent is extended or adjusted under 35 U.S.C. 154(b) by 551 days.

(21) Appl. No.: 15/008,775

(22) Filed: Jan. 28, 2016

(65) Prior Publication Data

US 2017/0027403 A1 Feb. 2, 2017

(30) Foreign Application Priority Data

Jul. 27, 2015 (CN) ..... 2015 2 0549959 U

(51) Int. Cl.
*A47L 13/254* (2006.01)
*A47L 13/24* (2006.01)

(52) U.S. Cl.
CPC ..... *A47L 13/254* (2013.01); *A47L 13/24* (2013.01)

(58) Field of Classification Search
CPC ..... A47L 13/14; A47L 13/253; A47L 13/254; A46B 5/0075; A46B 15/0055
See application file for complete search history.

(56) References Cited

U.S. PATENT DOCUMENTS 612,491 A * 10/1898 Eck ..... A46B 15/0055 15/111
624,310 A * 5/1899 Eck ..... A46B 15/0055 15/111
1,437,789 A * 12/1922 Whyte ..... A47L 13/253 15/229.7
1,810,026 A * 6/1931 Moller ..... E01H 5/02 15/105
2,032,664 A * 3/1936 Raptis ..... A46B 5/0075 15/144.1
2,789,298 A * 4/1957 Peterson ..... A47L 13/254 15/159.1

(Continued)

FOREIGN PATENT DOCUMENTS

CN 203388808 U * 1/2014 ..... A47L 13/254
CN 204336842 U 5/2015
WO WO 2009157862 A1 * 12/2009 ..... A47L 13/254

*Primary Examiner* — Joseph J Hail
*Assistant Examiner* — Arman Milanian
(74) *Attorney, Agent, or Firm* — Muncy, Geissler, Olds & Lowe, P.C.

(57) ABSTRACT

A flat mop includes a mop head, a bridge seat, a mop handle and a pivot connecting member. The mop head includes a guide track, which is installed with the bridge seat therein and includes at least two positioning points. The bridge seat includes a base, an abutment elastic body installed at the base, a sliding body disposed correspondingly to the abutment elastic body and stopped at one of the positioning points when the bridge seat displaces levelly relative to the mop head to limit the movement of the bridge seat, and two locking portions respectively located at two opposite sides of the base. The mop handle includes a movement space for allowing the bridge seat to move therein, and a positioning portion disposed correspondingly to the movement space and fastening with one of the locking portions after the bridge seat moves relative to the mop handle.

10 Claims, 8 Drawing Sheets

(56) References Cited

U.S. PATENT DOCUMENTS

| | | | | | |
|---|---|---|---|---|---|
| 3,795,933 | A * | 3/1974 | Seufert | A47L 13/12 | 15/114 |
| 5,414,889 | A * | 5/1995 | Sartori | A46B 5/0075 | 15/144.1 |
| D374,352 | S * | 10/1996 | Sartori | D4/121 | |
| 6,546,584 | B2 * | 4/2003 | Hobden | B05C 17/00 | 15/144.1 |
| 8,108,961 | B2 * | 2/2012 | Lin | A46B 5/0058 | 15/159.1 |
| 8,561,246 | B2 | 10/2013 | Johansson | | |
| 2002/0138933 | A1 * | 10/2002 | Slager, Sr. | A47L 13/24 | 15/229.6 |
| 2005/0102781 | A1 * | 5/2005 | Tsuchiya | A47L 13/20 | 15/147.2 |
| 2013/0019428 | A1 * | 1/2013 | Johansson | A47L 13/254 | 15/228 |
| 2018/0116480 | A1 * | 5/2018 | Shin | A47L 13/44 | |

* cited by examiner

FLAT MOP

FIELD OF THE INVENTION

The present invention relates to a flat mop.

BACKGROUND OF THE INVENTION

A flat mop is a common floor cleaning tool. In current commercially available flat mops, a mop seat is designed to have a plate form in order to increase the cleaning area of the flat mop. However, in a current flat mop, a mop handle and a mop seat have a fixed design, in a way that the mop handle is incapable of moving levelly to the left and right relative to the mop seat. As such, when the flat mop is applied to cleaning locations such as small gaps and under the sofa, the flat mop may not truly enter these locations, hence disfavoring the cleaning process. In addition, when storing such current flat mop, a larger storage space is usually occupied also due to the fixed structure.

In view of the above, a mop, such as disclosed by the China Patent Application No. 201420631033.1, is provided by a manufacturer. The above mop includes a mop handle and a mop seat. The mop seat includes a joint below, and a sliding mechanism is provided below the joint. The sliding mechanism includes a sliding block and a strip-like elastic piece. An elastic protruding structure for coordinating and fastening with a notch of the joint is provided at each of left and right sides of the sliding block. The strip-like elastic piece is disposed in a second cavity. The mop seat is provided below the sliding mechanism, and includes a first groove. The first groove and the strip-like elastic piece are coordinated with each other to form a positioning structure.

In addition to the disclosure above, the U.S. Pat. No. 8,561,246 discloses a displaceable handle attachment. The displaceable handle attachment is installed in a displaceable frame of a mop head. The handle attachment is capable of moving in a guide groove on the frame along a displacement direction. The displaceable handle attachment includes a slider located in the guide groove, and a biasing means. The slider includes at least one engagement surface for frictional engagement with a respective cooperating surface of the guide groove. The biasing means has a biasing force that biases the engagement surface of the slider against the cooperating surface of the guide groove. By pressing downwards and separating the engagement surface of the slider from the cooperating surface of the guide groove, the handle attachment and the slider counteract the biasing force of the biasing means.

Although the above disclosed solution achieves the object of changing the form of the mop to a certain extent, conventional solutions nonetheless contain following issues. For example, in the U.S. Pat. No. 8,561,246, the movement of the handle attachment is limited through the biasing force of the slider and the guide groove. However, during a cleaning process, a user may unintentionally disengage the limitation of the handle attachment to cause the handle attachment to displace incorrectly and to affect the normal application of the disclosure. That is to say, the above disclosure is incapable of effectively stabilizing the handle attachment. In addition, the handle attachment becomes prone to damages when implemented through a biasing force, such that the lifecycle of the mop head may be shortened. Further, a conventional mop handle also suffer from other issues including being incapable of levelly moving to the right and left and occupying an excessive storage space. In the above disclosure, the positioning between the mop handle and the mop seat is primarily achieved using the strip-like elastic piece. The strip-like elastic piece not only can be quite easily worn out by the repeated sliding movements, but also likely causes wear of the groove. As a result, the mop handle and the mop seat may fail to be securely positioned.

SUMMARY OF THE INVENTION

The primary object of the present invention is to solve application issues of a conventional flat mop.

To achieve the above object, the present invention provides a flat mop. The flat mop of the present invention includes a mop head in form of a flat plate, a bridge seat assembled with the mop head and capable of levelly displacing relative to the mop head, a mop handle, and a pivot connecting member connected to the bridge seat and the mop handle and allowing the bridge head to rotate relative to the mop handle. The mop head includes a guide track, which is installed with the bridge seat therein and guides the bridge seat. The flat mop is characterized that, the mop head includes at least two positioning points separately disposed in the guide track; the bridge seat includes a base, an abutment elastic body installed at the base, and a sliding body disposed correspondingly to the abutment elastic body, being in contact with a surface of the guide track, and stopped at one of the positioning points when the bridge head levelly displaces relative to the mop head to limit the movement of the bridge seat; the mop handle includes a movement space facing the mop head and for the bridge seat to move therein, and a positioning portion disposed correspondingly to the movement space and fastening with one of the locking portions after the bridge seat is moved relative to the mop handle; and the mop head is fixed on a horizontal direction after the locking portion and the positioning portion are fastened with each other.

In one embodiment, one side of the base facing the mop head includes an accommodating groove for sequentially disposing the abutment elastic body and the sliding body. The abutment elastic body includes one end abutting against a bottom of the accommodating groove and the other end abutting against the sliding body.

In one embodiment, each of the positioning points is a protrusion or a recess of the mop head located at the guide track.

In one embodiment, the mop head includes a limiting stop block disposed in the guide track and for stopping the bridge seat.

In one embodiment, one of the positioning points is disposed adjacently to a middle position of the guide track, and the remaining positioning points are disposed with a space from one another towards one single direction in the guide track by regarding the positioning point disposed adjacently to the middle position as a basis. The limiting stop block is disposed in a direction opposite the positioning points.

In one embodiment, each of the locking portions is a locking recess disposed at each of two opposite sides of the base, and the positioning portion is a positioning pin disposed at the mop handle to correspond to the movement space.

In one embodiment, each of the locking recesses includes a limiting inclined surface disposed at one side near the mop handle, a guiding inclined surface disposed at one side away from the mop handle, and an abutment connecting plane between the limiting inclined surface and the guiding inclined surface. The positioning pin includes a first positioning inclined surface, a second positioning inclined surface, and a connecting plane between the first positioning inclined surface and the second positioning inclined surface. The slopes of the limiting inclined surface, the guiding inclined surface, the first positioning inclined surface and the second positioning inclined surface are equal.

In one embodiment, the movement space and the positioning pin are disposed on a sleeve included at the mop handle. The sleeve includes a sleeve body, an accommodating chamber disposed on the sleeve body and for accommodating the positioning pin, a support elastic body placed in the accommodating chamber and connected to the positioning pin to cause the positioning pin to displace back and forth, and a limiting rib disposed at an inner edge of the accommodating chamber. The positioning pin includes a stop rib protruding from a surface of the positioning pin and abutting against the limiting rib during the displacement process of the positioning pin.

In one embodiment, the base includes an installation groove, and two pivotal connecting portions respectively disposed at two opposite sides of the installation groove. The pivot connecting member includes a connecting base, two first axial connecting portions and a second axial connecting portion. The two first axial connecting portions are respectively disposed at two opposite sides of the connecting base, and are respectively connected to the pivotal connecting portions to cause the connecting base to turn relative to the base. The second axial connecting portion is connected to the connecting base, and is assembled with the sleeve body to enable the mop handle to rotate relative to the bridge seat.

In one embodiment, the mop head includes at least one sealing frame disposed at one side of the mop head and for sealing the guide track.

With the above technical solution, the present invention provides following features compared to the prior art. In the present invention, the bridge seat is positioned at one of the positioning points at the mop seat according to application requirements, so as to change the form of the flat mop to adapt to cleaning requirements, e.g., to clean a small space. In the present invention, the sliding body is adopted to substantially prevent the issue of wear that may be caused by leveled movements of the bridge seat. Further, in the present invention, the locking portion is disposed on the bridge seat, and the positioning portion is disposed on the mop handle. By fastening the locking portion and the positioning portion with each other, the mop seat can be fixed on the horizontal direction of the mop handle to provide easy storage and to prevent a cleaning member on the mop head from coining into contact with the floor. Further, the mop head of the present invention can be collapsed without involving other elements. The overall structure of the flat mop of the present invention is quite simple and thus provides a user with convenience-enhanced user experiences. These features above are apparently unobtainable from conventional structures.

DETAILED DESCRIPTION OF THE PREFERRED EMBODIMENTS

Figure 1:
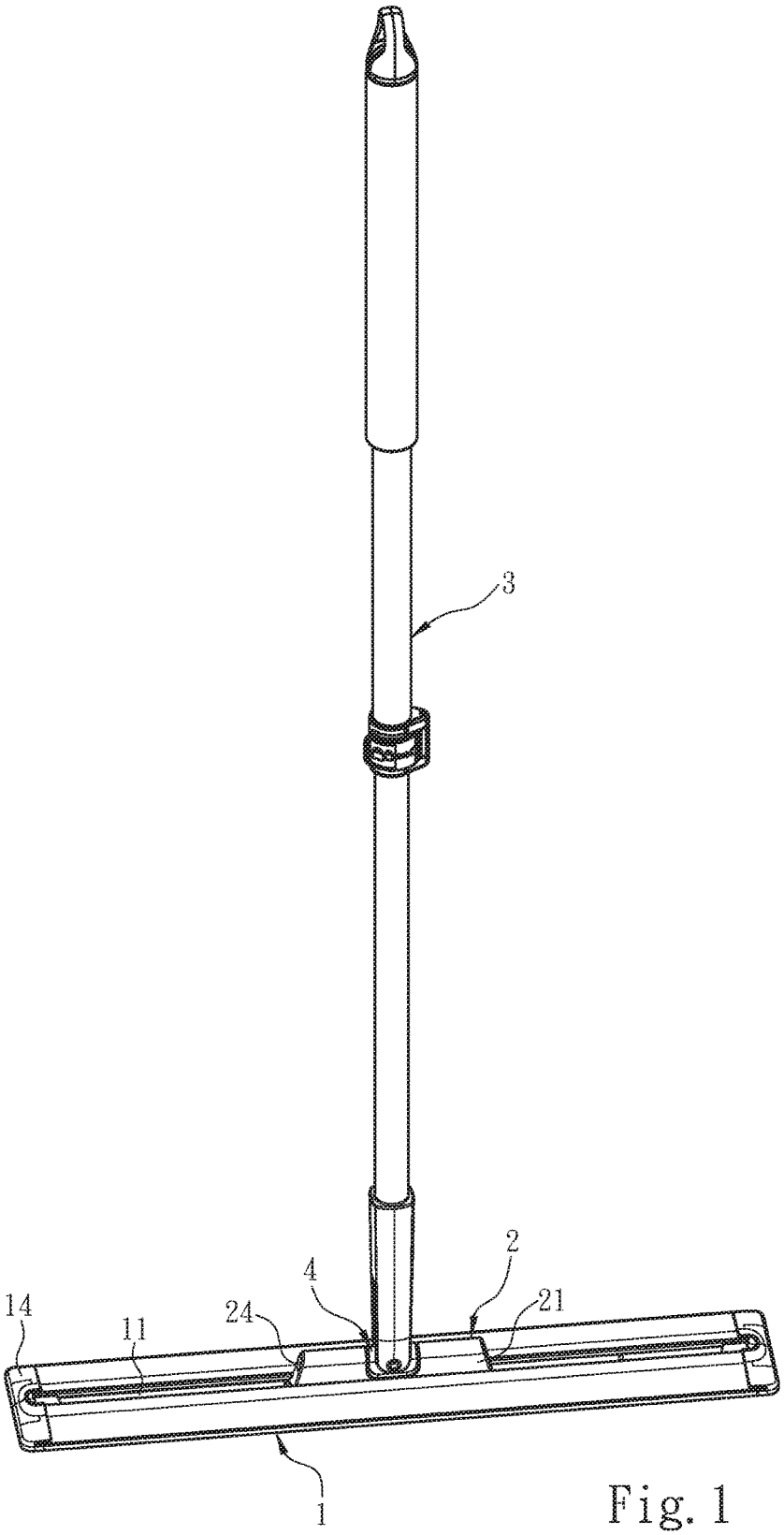
FIG. 1 is an appearance perspective view according to an embodiment of the present invention.
Figure 2:
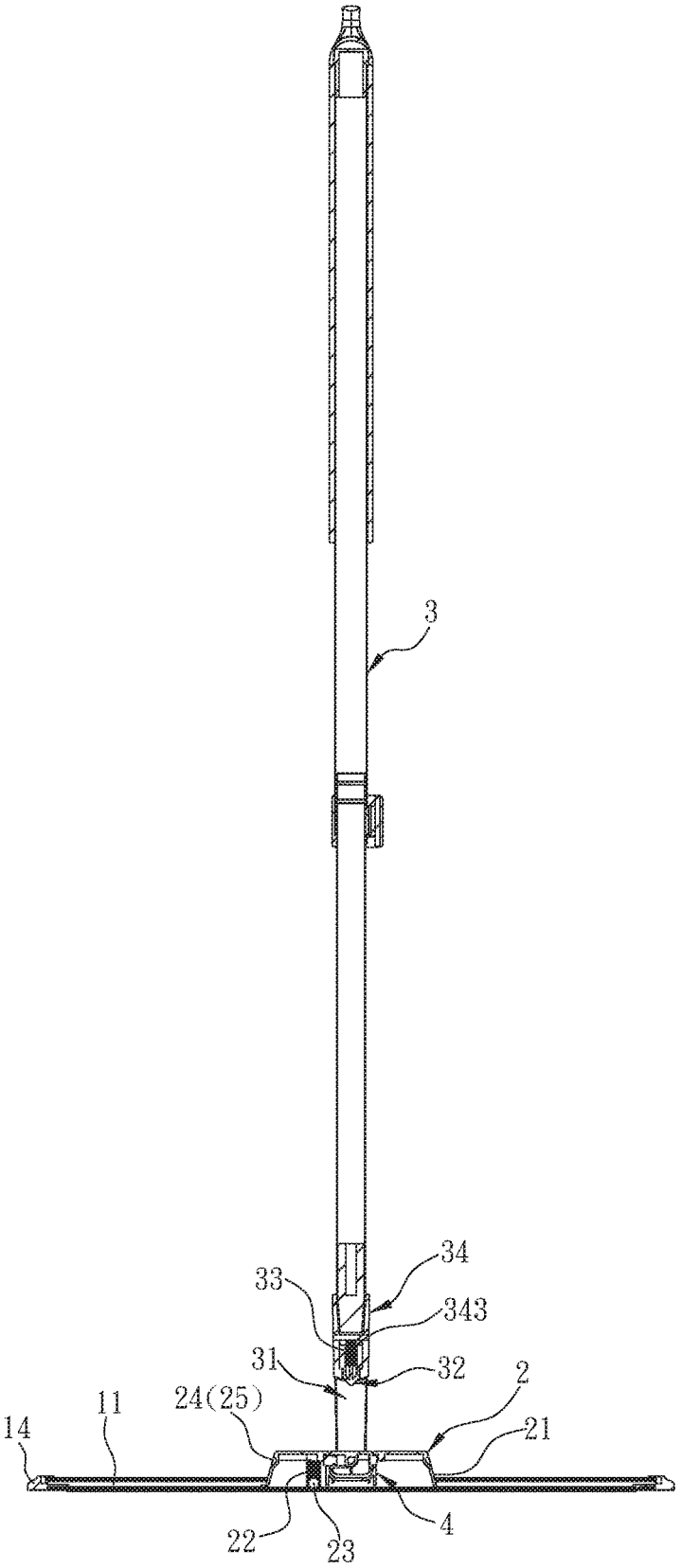
FIG. 2 is a structural sectional view along a first direction according to an embodiment of the present invention.
Figure 3:
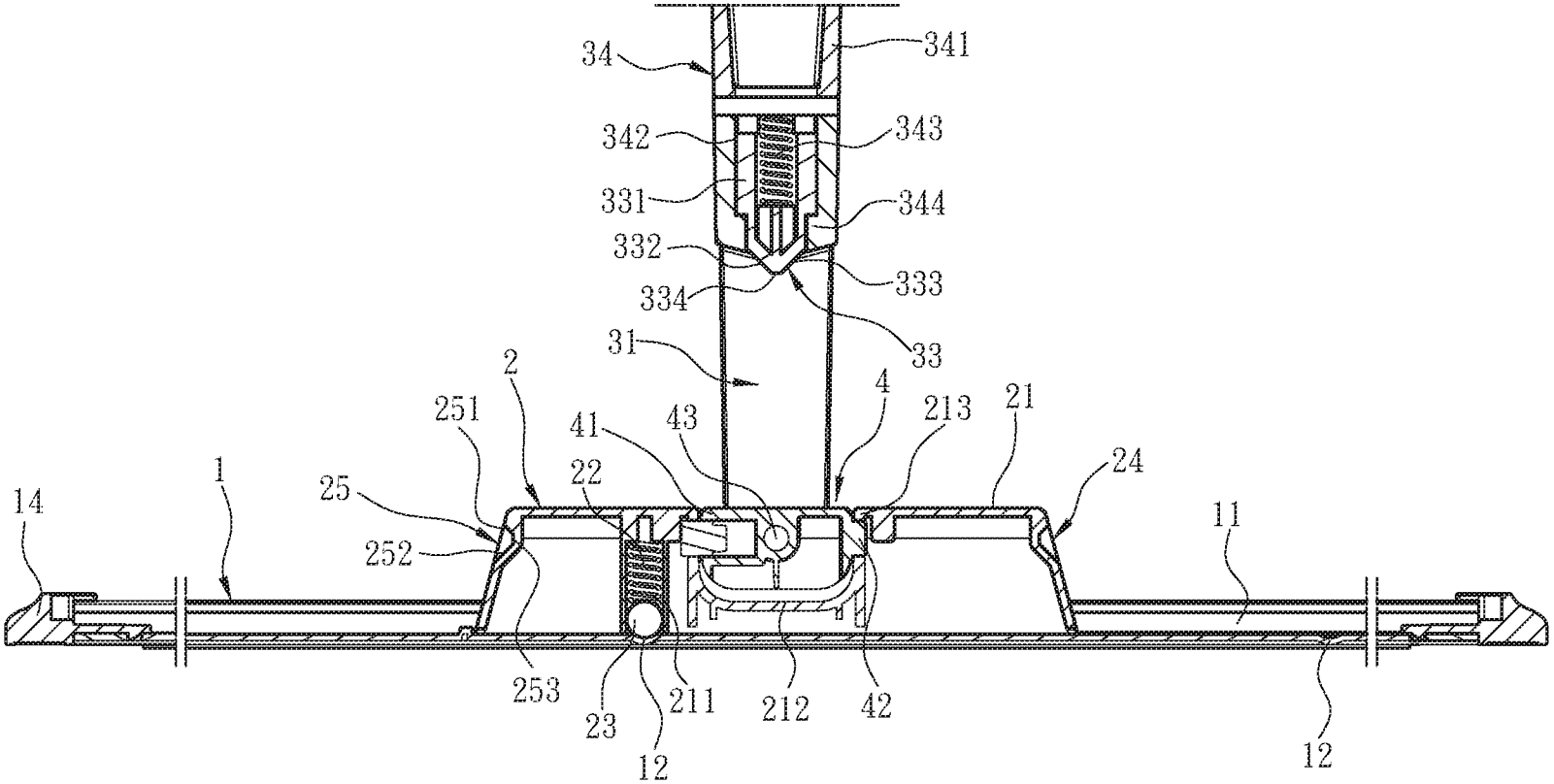
FIG. 3 is a partial structural sectional view along the first direction according to an embodiment of the present invention.
Figure 4:
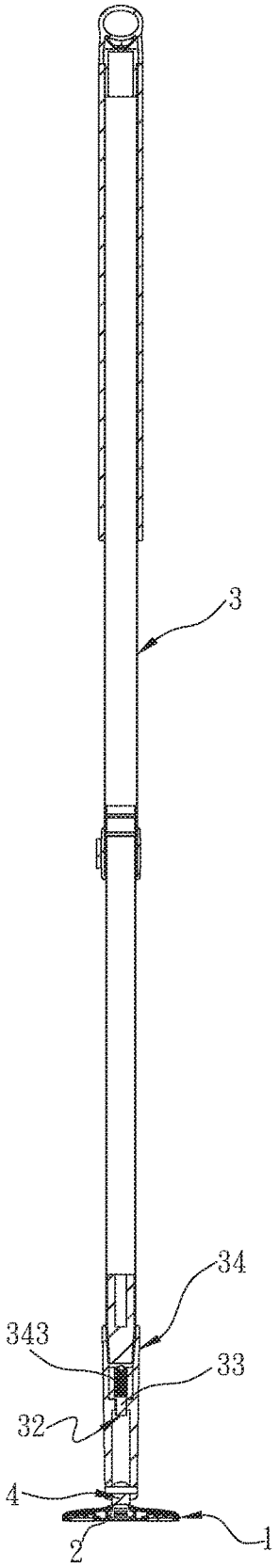
FIG. 4 is a structural sectional view along a second direction according to an embodiment of the present invention.
Figure 5:
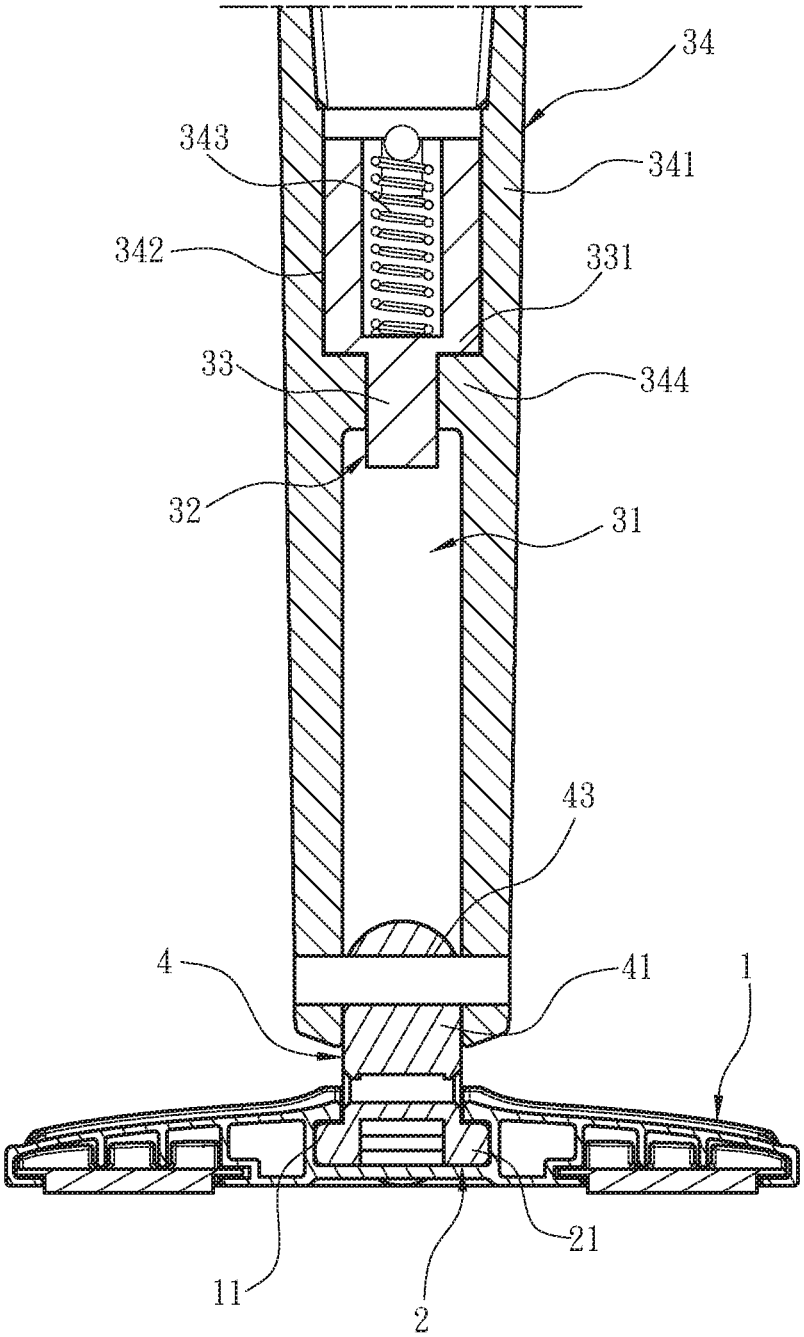
FIG. 5 is a partial structural sectional view along the second direction according to an embodiment of the present invention.

Details and technical contents of the present invention are given with the accompanying drawings below.

Referring to FIG. 1 to FIG. 5, a flat mop of the present invention includes a mop head 1 in form of a flat plate, a bridge seat 2 assembled with the mop head 1 and capable of levelly displacing back and forth relative to the mop head 1, a mop handle 3, and a pivot connecting member 4 connected to the bridge seat 2 and the mop handle 3 and allowing the bridge seat 2 to rotate relative to the mop handle 3. Further, the mop head 1 includes a guide track 11, which is installed with the bridge seat 2 therein and guides the bridge seat 2. The guide track 11 is configured and disposed along an axial direction of the mop head 1. The mop head 1 may further be provided with a cleaning member, e.g., cleaning fabric. Further, in the present invention, the mop head 1 further includes at least two positioning points 12 separately disposed in the guide track 11. Each of the positioning points 12 is a protrusion or a recess of the mop head 1 located in the guide track 11. It should be noted that, the positioning point 12 is illustrated in form of a recess as an example rather than a limitation to the present invention. Further, an overall form of each of the positioning points 12 may be a curved structure, so as to temporarily limiting instead of absolutely limiting the movement of the bridge seat 2.

Figure 6:
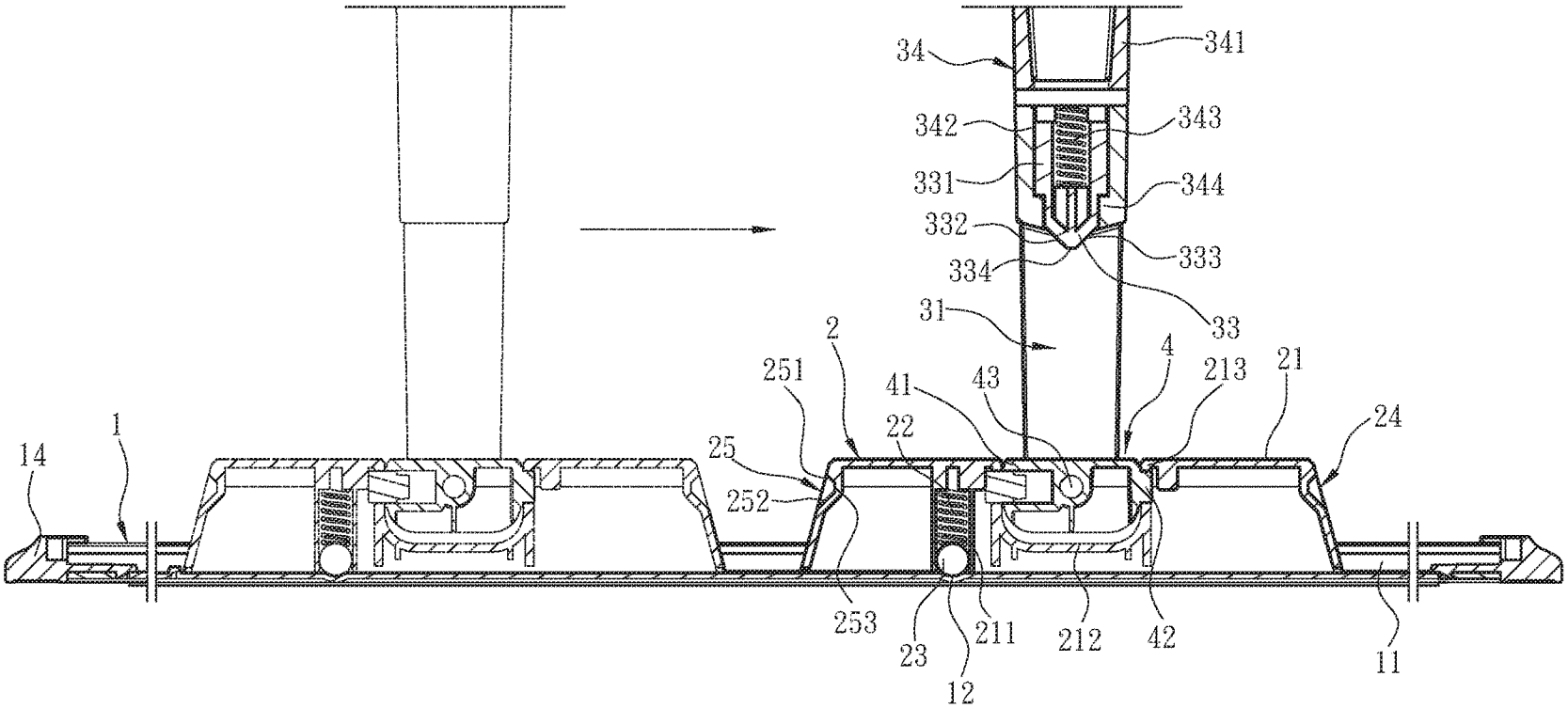
FIG. 6 is a schematic diagram of a bridge seat moving levelly according to an embodiment of the present invention.

The bridge seat 2 includes a base 21, an abutment elastic body 22 installed at the base 21, and a sliding body 23 disposed correspondingly to the abutment elastic body 22 and being in contact with a surface of the guide track 11. More specifically, the base 21 may be configured as being provided in the guide track 11, and is capable of sliding relative to the guide track 11. One side of the base 21 facing the mop head 1 includes an accommodating groove 211 for sequentially disposing the abutment elastic body 22 and the sliding body 23. Accordingly, the abutment elastic body 22 includes one end abutting against a bottom of the accommodating groove 211, and the other end abutting against the sliding body 23. That is to say, regarding the assembly orders of the abutment elastic body 22 and the sliding body 23, the abutment elastic body 22 is first installed in the accommodating groove 211, and the sliding body 23 is then disposed on the abutment elastic body 22 and is located at an opening of the accommodating groove 211. Thus, the abutment elastic body 22 constantly applies a directional force upon the sliding body 23, so as to cause the sliding body 23 to be in constant contact with the surface of the guide track 11 when the bridge seat 2 is assembled with the mop head 1. Referring to FIG. 6, when the bridge seat 2 receives a force applied by a user and levelly moves along the guide track 11, the sliding body 23 continually slides at the surface of the guide track 11 until it touches one of the positioning points 12. Under the effect of the positioning point 12, the sliding body 23 temporarily limits the movement of the bridge seat 2, such that the position of the bridge seat 2 in the guide track 11 is changed. However, as the positioning point 12 of the present invention only temporarily limits the movement of the bridge seat 2, when the user wishes to again adjust the position of the bridge seat 2, the user is only required to apply a force of the same direction. Thus, the sliding body 23 disengages from the current positioning point 12 and displaces in the guide track 11 until it touches another positioning point 12. Accordingly, in the present invention, multiple stopping sections are formed by the positioning points 12, so that the user may adjust the position of the bridge seat 2 in the guide track 11 according to actual application requirements. Further, in one embodiment, the mop head 1 includes at least one sealing frame 14 disposed at one end of the mop head 1 to seal the guide track 11.

In one embodiment, the mop head 1 includes a limiting stop block 13 disposed in the guide track 11 and for stopping the bridge seat 2. The limiting stop block 13 is different from the positioning points 12. More specifically, designed to directly limit the movement of the bridge seat 2, the limiting stop block 13 noticeably protrudes from the surface of the guide track 11, whereas the positioning points 12 only limit the sliding movement of the sliding body 23 instead of directly limiting the bridge seat 2. One of the positioning points 12 is disposed adjacently to a middle position of the guide track 11, the remaining positioning points 12 are disposed with a space from one another towards one single direction in the guide track 11 by regarding the positioning point 12 disposed adjacently to the middle position as a basis, and the limiting stop block 13 is disposed in a direction opposite the positioning points 12.

Figure 7:
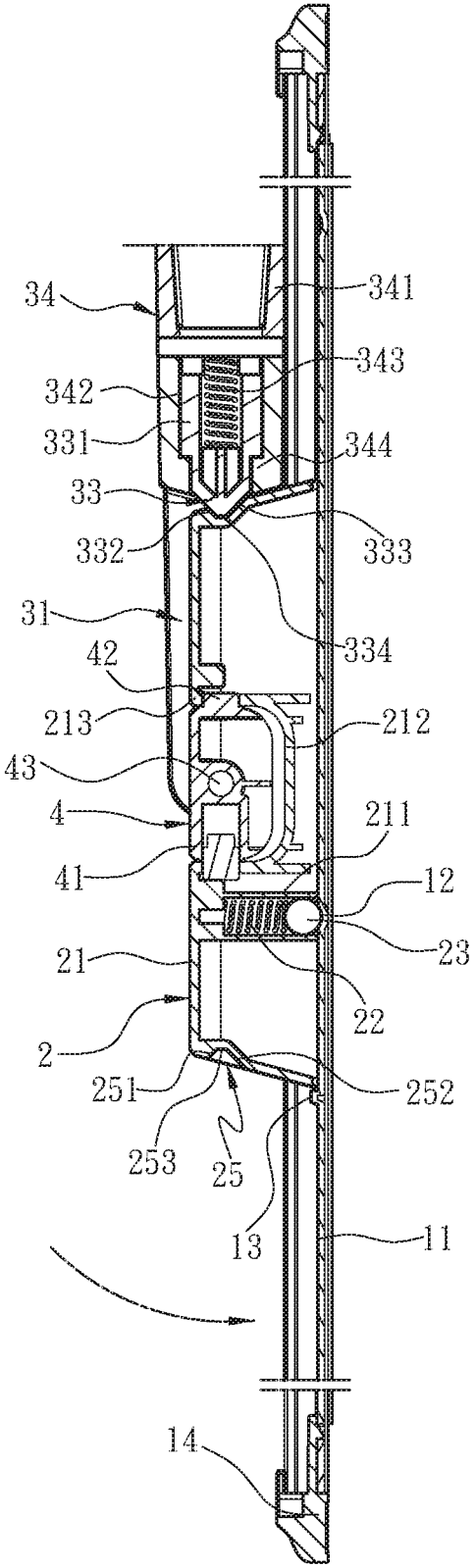
FIG. 7 is a first schematic diagram of rotating a mop head according to an embodiment of the present invention.
Figure 8:
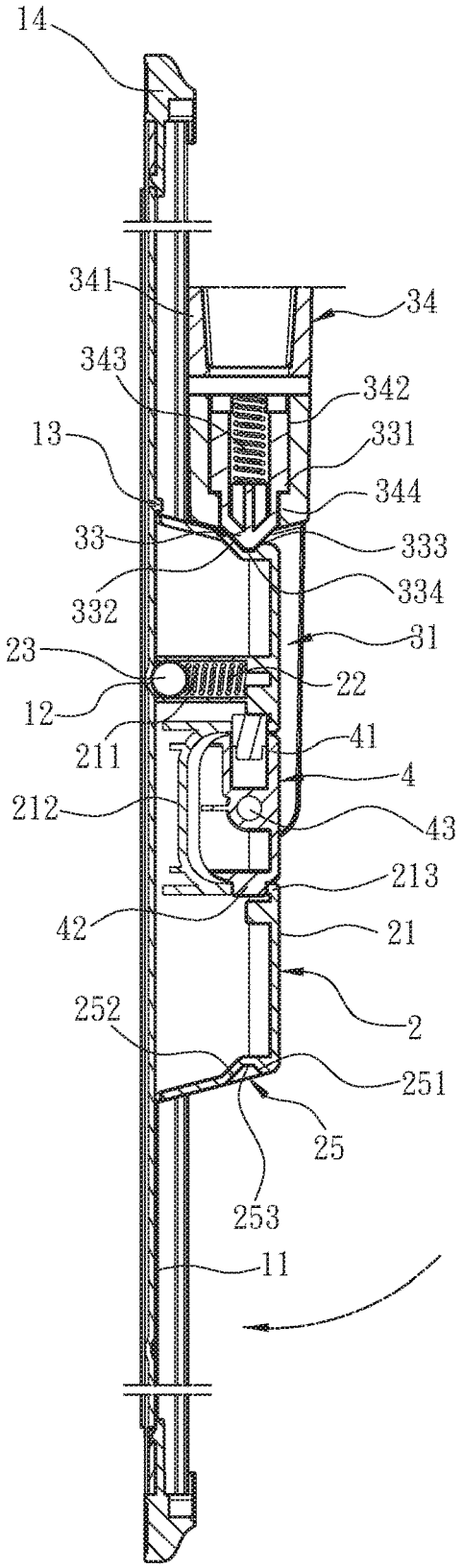
FIG. 8 is a second schematic diagram of rotating a mop head according to an embodiment of the present invention.

Referring to FIG. 1 to FIG. 5, the bridge seat 2 of the present invention further includes two locking portions 24 located at two opposite sides of the base 21, respectively. The mop handle 3 includes a movement space 31 facing the mop head 1, and a positioning portion 32 disposed correspondingly to the movement space 31. The bridge seat 2 is capable of moving in the movement space 31. When the bridge seat 2 moves relative to the mop handle 3 in a way that the mop head 1 is parallel to the mop handle 3, the positioning portion 32 may be fastened with one of the locking portion 24, such that the mop head 1 is fixed on a horizontal direction of the mop handle 3. Further, the bridge seat 2 of the present invention is capable of rotating in different directions relative to the mop handle 3 because of the pivot connecting member 4. When the bridge seat 2 is rotated, one of the locking portions 24 is allowed to fasten with the positioning portion 32, as shown in FIG. 7 and FIG. 8. When the flat mop of the present invention enters a utilization state, an included angle between the mop head 1 and the mop handle 3 is 90 degrees; when the flat mop enters a storage state, the included angle between the mop head 1 and the mop handle 3 is 0 and 180 degrees. Thus, not only the storage space of the flat mop may be reduced for easier transportation, but also a fungi and bacteria can be prevented from forming on a cleaning member (not shown) on the mop head 1 after a cleaning process during which the cleaning member is in direct contact with the floor. Further, when the flat mop of the present invention is in a storage state, it may also be applied to clean small gaps or under the sofa.

Again referring to FIG. 1 to FIG. 5, in one embodiment, each of the locking portions 24 is a locking recess 25 disposed at each of two opposite sides of the base 21, and the positioning portion 32 is a positioning pin 33 disposed at the mop handle 3 to correspond to the movement space 31. Each of the locking recesses 25 includes a limiting inclined surface 251 disposed at one side near the mop handle 3, a guiding inclined surface 252 disposed at one side away from the mop handle 3, and an abutment connecting plane 253 between the limiting inclined surface 251 and the guiding inclined surface 252. The positioning pin 33 includes a first positioning inclined surface 332, a second positioning inclined surface 333, and a connecting plane 334 between the first positioning inclined surface 332 and the second positioning inclined surface 333. Further, the slopes of the limiting inclined surface 251, the guiding inclined surface 252, the first positioning inclined surface 332 and the second positioning inclined surface 333 are equal. Thus, with the limiting inclined surface 251, the guiding inclined surface 252, the first positioning inclined surface 332 and the second positioning inclined surface 333, the locking recess 25 and the positioning pin 33 are substantially limited. Further, the movement space 31 and the positioning pin 33 are disposed on a sleeve 34 included at the mop handle 3. The sleeve 34 includes a sleeve body 341, an accommodating chamber 342 disposed on the sleeve body 341 and for accommodating the positioning pin 33, a support elastic body 343 placed in the accommodating chamber 342 and connected to the positioning pin 33 to cause the positioning pin 33 to displace back and forth, and a limiting rib 344 disposed at an inner edge of the accommodating chamber 342. The positioning pin 33 includes a stop rib 331 protruding from a surface of the positioning pin 33 and abutting against the limiting rib 344 during the displacement process of the positioning pin 33. When the flat mop is to enter a storage state and the bridge seat 2 is rotated relative to the mop handle 3, the positioning pin 33 is first pushed by a side of the bridge seat 2 to further push the support elastic body 343 to displace towards the accommodating chamber 342. The positioning pin 33 then moves along an outer edge of the bridge seat 2 until the positioning pin 33 is fastened in the locking recess 25. Hence, the positioning pin 33 is fastened with the locking recess 25, so that the bridge seat 2 is prohibited from moving randomly and the flat mop is allowed to enter a storage state. As such, through the above application method, the mop head 1 and the mop handle 3 may be expanded or collapsed. Further, through the above feature, during the process of collapsing the flat mop, fastening can be achieved by one of the locking portions 24 provided on the bridge seat 2 and the positioning portion 32 on the mop handle 3 without involving an external element. Therefore, convenience-enhanced user experiences can be provided, and a user is enabled to complete the collapsing process of the flat mop without needing to fetch or operate an external element.

Again referring to FIG. 1 to FIG. 5, the base 21 of the present invention further includes an installation groove 212, and two pivotal connecting portions 213 respectively disposed at two opposite sides of the installation groove 212. The pivot connecting member 4 includes a connecting base 41, two first axial connecting portions 42 and a second axial connecting portion 43. The two first axial connecting portions 42 are respectively disposed at two opposite sides of the connecting base 41, and are respectively connected to the two pivotal connecting portions 213 to allow the connecting base 41 to turn relative to the base 21. The second axial connecting portion 43 is connected to the connecting base 41, and is assembled with the sleeve body 341 to enable the mop handle 3 to rotate relative to the bridge seat 2. In the present invention, in addition to assembling to the bridge seat 2 and the mop handle 3 with the first axial connecting portions 42 and the second axial connecting portion 43, the pivot connecting member 4 further offers a multi-directional rotation function with the first axial connecting portions 42 and the second axial connecting portion 43.

What is claimed is:

1. A flat mop, comprising a mop head in form of a flat plate, a bridge seat assembled with the mop head and capable of levelly displacing back and forth relative to the mop head, a mop handle, a pivot connecting member connected to the bridge seat and the mop handle and allowing the bridge seat to rotate relative to the mop handle, the mop head comprising a guide track that is installed with the bridge seat therein and guides the bridge seat; the flat mop being characterized that: the mop head comprises at least two positioning points separately disposed in the guide track; the bridge seat comprises a base, an abutment elastic body installed at the base, a sliding body disposed correspondingly to the abutment elastic body, being in contact with a surface of the guide track and stopped at one of the positioning points when the bridge seat displaces levelly relative to the mop head to limit a movement of the bridge seat, and two locking portions respectively located at two opposite sides of the base, wherein the upper surface of the bridge seat is without locking portions; the mop handle comprises a movement space facing the mop head and allowing the bridge seat to move therein, a positioning portion disposed correspondingly to the movement space and fastening with one of the locking portions after the bridge seat moves relative to the mop handle, and the movement space and the positioning portion disposed on a sleeve; the mop head is fixed on a horizontal direction of the mop handle after the locking portion and the positioning portion are fastened with each other; and the sleeve comprises a sleeve body, an accommodating chamber disposed on the sleeve body and for accommodating the positioning portion, a support elastic body placed in the accommodating chamber and connected to the positioning portion to cause the positioning portion to displace back and forth, and a limiting rib disposed at an inner edge of the accommodating chamber.

2. The flat mop of claim 1, wherein one side of the base facing the mop head comprises an accommodating groove for sequentially disposing the abutment elastic body and the sliding body; and the abutment elastic body includes one end abutting against a bottom of the accommodating groove and one other end abutting against the sliding body.

3. The flat mop of claim 1, wherein each of the positioning points is a protrusion or a recess of the mop head located in the guide track.

4. The flat mop of claim 3, wherein the mop head comprises a limiting stop block disposed in the guide track and for stopping the bridge seat.

5. The flat mop of claim 4, wherein one of the positioning points is disposed adjacently to a middle position of the guide track, the remaining positioning points are disposed with a space from one another towards one single direction in the guide track by regarding the positioning point disposed adjacently to the middle position as a basis, and the limiting stop block is disposed in a direction opposite the positioning points.

6. The flat mop of claim 1, wherein each of the locking portions is a locking recess disposed at each of two opposite sides of the base, and the positioning portion is a positioning pin disposed at the mop handle to correspond to the movement space.

7. The flat mop of claim 6, wherein each of the locking recesses comprises a limiting inclined surface disposed at one side near the mop handle, a guiding inclined surface disposed at one side away from the mop handle, and an abutment connecting plane between the limiting inclined surface and the guiding inclined surface; the positioning pin comprises a first positioning inclined surface, a second positioning inclined surface, and a connecting plane between the first positioning inclined surface and the second positioning inclined surface; and slopes of the limiting inclined surface, the guiding inclined surface, the first positioning inclined surface and the second positioning inclined surface are equal.

8. The flat mop of claim 7, wherein the positioning pin comprises a stop rib protruding from the surface of the positioning pin and abutting against the limiting rib during a displacement process of the positioning pin.

9. The flat mop of claim 8, wherein the base comprises an installation groove, and two pivotal connecting portions respectively at two opposite sides of the installation groove; the pivot connecting member comprises a connecting base, two first axial connecting portions and a second axial connecting portion; the two first axial connecting portions are respectively disposed at two opposite sides of the connecting base and are respectively connected to the pivotal connecting portions to cause the connecting base to turn relative to the base; and the second axial connecting portion is connected to the connecting base, and is assembled with the sleeve body to enable the mop handle to rotate relative to the bridge seat.

10. The flat mop of claim 9, wherein the mop head comprises at least one sealing frame disposed at one side of the mop head and sealing the guide track.

* * * * *